US005730930A

United States Patent [19]

Velten et al.

[11] Patent Number: 5,730,930

[45] Date of Patent: Mar. 24, 1998

[54] METHOD AND DEVICE FOR EXCHANGING THE ATMOSPHERE IN A HOOD-SHAPED ANNEALING FURNACE

[75] Inventors: Georg Velten, Essen; Friedhelm Kühn, Mülheim; Walter Scheuermann, Bonn, all of Germany

[73] Assignee: LOI Thermprocess GmbH, Germany

[21] Appl. No.: 571,825

[22] PCT Filed: Aug. 6, 1994

[86] PCT No.: PCT/EP94/02619

§ 371 Date: Feb. 16, 1996

§ 102(e) Date: Feb. 16, 1996

[87] PCT Pub. No.: WO95/05487

PCT Pub. Date: Feb. 23, 1995

[30] Foreign Application Priority Data

Aug. 19, 1993 [DE] Germany ..... 43 27 975.9

[51] Int. Cl.[6] ..... C21D 9/67

[52] U.S. Cl. ..... 266/44; 266/252; 266/256

[58] Field of Search ..... 266/252, 256, 266/249, 44; 432/77, 206

[56] References Cited

U.S. PATENT DOCUMENTS

| | | | |
|---|---|---|---|
| 4,596,526 | 6/1986 | Soliman | 266/256 |
| 4,846,675 | 7/1989 | Soliman | 266/256 |
| 5,112,030 | 5/1992 | Tahara et al. | 266/256 |
| 5,380,378 | 1/1995 | Hemsath | 266/256 |

*Primary Examiner*—Scott Kastler

*Attorney, Agent, or Firm*—Blakely Sokoloff Taylor & Zafman

[57] ABSTRACT

Fresh gas is blown into the ring-shaped space between the annealing charge and the hood as an upwardly directed high-speed jet (9) at a velocity of approximately 80 m/s. The gas mixture which forms is evacuated through a gas outlet (10) arranged in the pedestal and diametrically opposite to the gas inlet. At a volume flow rate of about 130 $m^3/s$, rinsing takes about 6 minutes.

6 Claims, 1 Drawing Sheet

METHOD AND DEVICE FOR EXCHANGING THE ATMOSPHERE IN A HOOD-SHAPED ANNEALING FURNACE

The present invention relates to a method for exchanging the atmosphere in a hood-type annealing furnace, the fresh gas being blown into the furnace from below and the gas mixture forming being evacuated from the furnace from below. Furthermore, the present invention relates to a hood-type annealing furnace to perform this method, with a pedestal, a plate to carry the annealing charge arranged on the pedestal, a blower arranged below a central aperture of the annealing charge plate, a hood surrounding the annealing charge and the annealing charge plate at a distance and at least one gas inlet and one gas outlet arranged in the pedestal.

Hood-type annealing furnaces are used in particular for heat-treatment of sheets which are wound in coils. The latter are stacked on top of each other on the annealing charge plate, their central "eye" forming a channel in the continuation of the central aperture of the annealing charge plate. Once the hood has been placed over the fresh charge, the air present in the furnace is exchanged for protective gas. Then the annealing treatment begins, the blower sucking in the gas centrally downwards from above and carrying the gas sideways into the ring-shaped space between the annealing charge and the hood.

At least one exchange of the atmosphere of the hood-type furnace is necessary per charge. If hydrogen is used, this procedure must be performed many times. The air must be evacuated from the furnace before heating commences. This is performed by blowing in nitrogen. Then hydrogen is fed in which dispels the nitrogen. After the annealing treatment has been completed, the hydrogen has to be dispelled by blowing in nitrogen before the hood can be removed.

When the atmosphere is exchanged, the fresh gas is blown into the furnace below the blower and carried by the blower into the ring-shaped space between the annealing charge and the hood. At the same time, the gas mixture forming is evacuated through the gas outlet.

The amount of gas entering the furnace when the atmosphere is exchanged is quite considerable. The volume flow rate is 100 to 180 $m^3/h$ for a period of 20 to 40 minutes under normal conditions. However, this presupposes that the blower is fully functionable. If the blower fails, the rinsing time is approximately 24 hours. This loss of operating time is a very important factor. In addition, the gas consumption is quite nconsiderable.

The object of the present invention was to find a remedy and permit more cost-effective and, above all, quicker exchange of the atmosphere.

This object is solved by the method according to the present invention, characterised in that the fresh gas is blown in as an upwardly directed high-speed jet in a flow pathway leading upwards and that the following equation applies to the velocity of the jet.

$$v = \frac{K \cdot V_f \cdot M_A}{22.4 \cdot \rho_s \cdot A}$$

where $V_f$=free furnace chamber volume in litres $M_A$=molar weight of the gas to be rinsed out in g/mol $\rho_S$=density of the fresh gas in $g/m^3$ (these data apply to the normal condition)

A=entry cross-section of the fresh gas in $m^2$

K=factor with the value $\geqq 1$, preferably 6.

It may, under certain circumstances, be advantageous to generate a pulsating high-speed jet.

The inventive device is characterised in that the gas inlet is designed as an upwardly directly nozzle which terminates in a flow pathway leading upwards.

The present invention is based on the knowledge that the velocity of the jet entering the furnace decisively influences the exchange of the atmosphere and that, when optimising the velocity, the density of the gas to be rinsed out and the density of the fresh gas are to be taken into consideration in accordance with the above equation.

Surprisingly, it is possible with the inventive measures to accelerate exchange of the atmosphere to an extent which could not have been predicted. After only approximately 3 to 10 minutes, the desired residual content of gas to be replaced of approximately 4% has been achieved. A particularly surprising effect is that this result is achieved more or less regardless of whether the blower is running or not. This means that the rinsing time is shortened from 24 hours to approx. 5 minutes in cases where the blower is not working.

Apart from this really enormous time-saving, there is also a corresponding saving in rinsing gas as the volume flow rate does not have to be increased. An average flow rate of approximately 140 $m^3/h$ can be retained.

A not inconsiderable improvement in works safety must also be mentioned. When the blower failed during operation it was hitherto often not possible (or at least it appeared not to be possible) to allow the rinsing procedure for evacuating the hydrogen to run for 24 hours. The result was that the hood was removed prematurely with the risk of the residual mixture igniting.

The success of the present invention is above all attributable to the fact that the high-speed jet blown into the flow pathway leading upwards results in an extremely rapid and uniform mixture formation, provided the velocity and the channel dimensions are appropriately selected to suit each other. The jet enters the gas to be exchanged and simultaneously causes a suction effect. Furthermore, the jet is effective right up into the top of the hood. These effects can, under certain circumstances, be improved by a pulsating jet. Finally, the guidance of the jet, which starts at the level of the annealing charge plate, effectively prevents the gas streaming straight to the gas outlet.

Very good results were achieved with a smooth jet nozzle of constant diameter. However, nozzles with constrictions are also conceivable.

The high-speed jet can be directed through the central aperture of the annealing charge plate into the central channel formed by the "eyes" of the coils. It is then a good idea to design the shaft of the blower as a hollow shaft and, if necessary with a corresponding extension, to use it as a nozzle.

It may be more advantageous to allow the nozzle to terminate in the ring-shaped space between the annealing charge and the hood as particularly favourable afflux and suction conditions prevail here. This applies particularly when, as is proposed in an embodiment of the present invention, the ratio of the distance between the nozzle centreline and the hood to the nozzle outlet diameter is between 2.5 and 8. If it is, for example, a question of exchanging $H_2$ for $N_2$, the ratio is preferably >7.5.

It is advantageous if the nozzle terminates at the level of the annealing charge plate, an afflux length of a constant diameter which is roughly five times the nozzle outlet diameter being upstream of the nozzle mouth. It has been found that very favourable flow conditions can be achieved in this manner.

The nozzle outlet surface area is preferably approximately 10% of the gas outlet surface area. This also promotes the rinsing process.

The gas outlet is then preferably arranged in the ring-shaped space between the annealing charge and the hood diametrically opposite the nozzle. If several gas outlets and nozzles are provided, they are arranged on a common sector, the sectors lying opposite each other. In each case, a flow is created which follows the hood contour.

The gas outlet is preferably shielded by a baffle plate allocated to the blower so that it above all catches the flow near the hood, the transverse flows which have not followed the hood contour being deflected to a large extent.

Combinations of the inventive features which deviate from the aforementioned combinations are deemed to have been disclosed as essential to the present invention.

BRIEF DESCRIPTION OF THE DRAWING

The present invention will now be explained in greater detail in the following using a preferred embodiment and the attached drawing. The drawing shows a schematic vertical section through a hood-type annealing furnace according to the present invention.

The hood-type annealing furnace exhibits a pedestal 1 with an annealing charge plate 2. Said annealing charge plate 2 carries coils 3 stacked on top of each other, in this case four coils. The "eyes" of said coils 3 form a central channel 4 which joins a central aperture 5 of the annealing charge plate 2. A blower 6 is arranged below the central aperture 5. The coil 3 and the annealing charge plate 2 are covered by a hood 8 to form a ring-shaped space 7.

Figure 1:
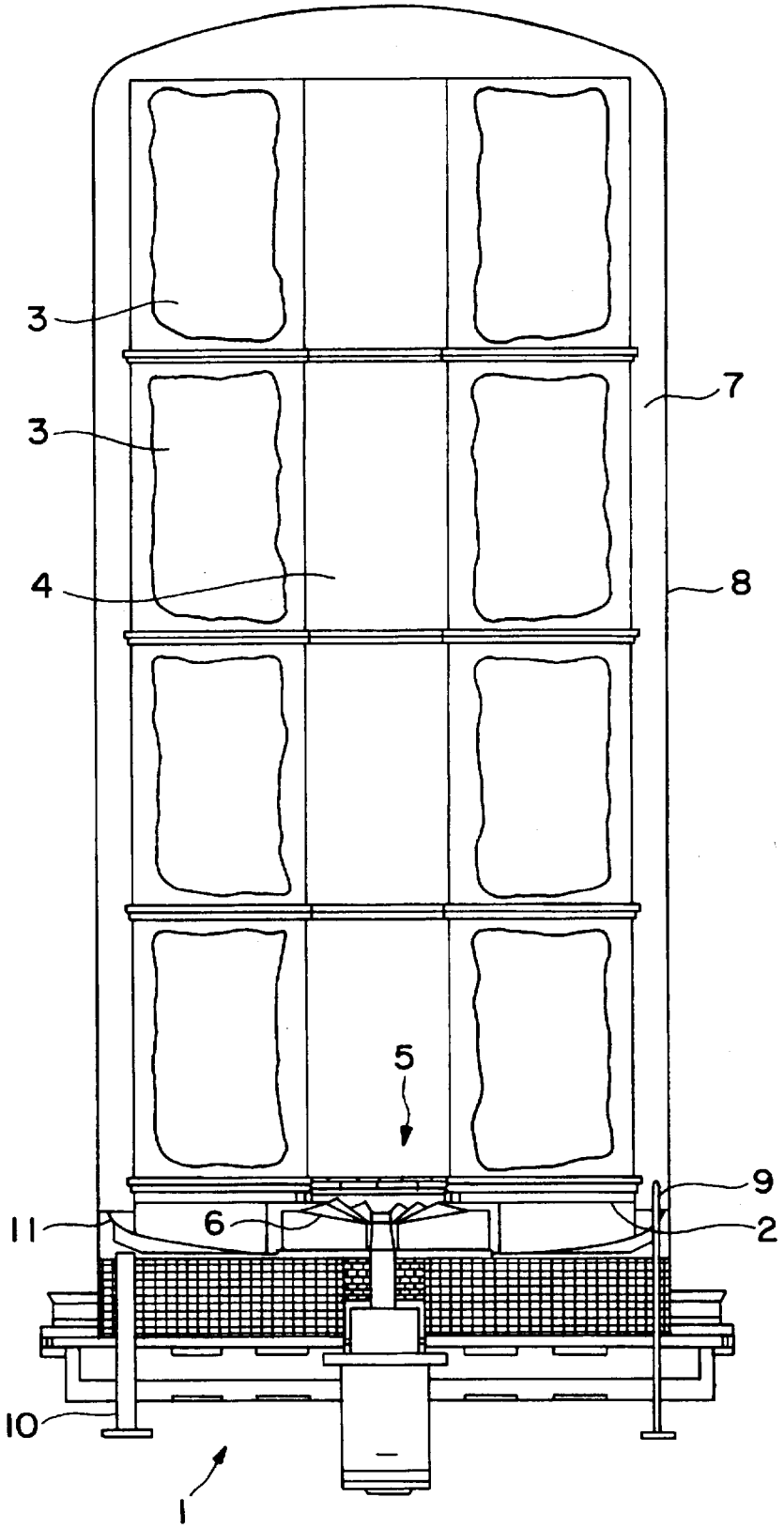

The hood-type annealing furnace has a gas inlet in the form of a nozzle 9 directed upwards which terminates in the ring-shaped space 7. Said nozzle generates a pulsating, upwardly directed high-speed jet, whose velocity is 75 m/s at a volume flow rate of 130 $m^3$/hour. It is a smooth jet nozzle with a diameter of 25 mm, the nozzle terminating at the level of the annealing charge plate 2. The ratio of the distance between the nozzle centreline and the hood to the nozzle diameter is 5.

A gas outlet 10 is provided diametrically opposite the nozzle 9 and also in the area of the ring-shaped space 7, the diameter of said gas outlet being 80 mm. The gas outlet is shielded by a baffle plate 11 allocated to the blower 6.

With this arrangement it only takes 6 minutes to rinse the $H_2$ atmosphere of the furnace with $N_2$ until there is only a residual content of 4% $H_2$, it being largely irrelevant whether the blower is on or off.

Variations of the embodiments described hereinabove are possible within the scope of the present invention. For example, the dimension and process parameters can be varied within limits as long as an upwardly directed high-speed jet with the desired suction, mixing and rinsing properties can be generated whose velocity corresponds to that described in the formula divulged in the present invention. This jet can also be directed, for example, through the shaft of the blower 6 into the central channel 4. Furthermore, it is possible to work with several gas inlets, and optionally also several gas outlets, the diametrically opposed arrangement should, however, be retained.

We claim:

1. A method for exchanging the atmosphere in a hood-shaped annealing furnace, said method comprising the steps:

a) fresh gas being blown from below into said hood-shaped annealing furnace;

b) providing a flow pathway in said hood-shaped annealing furnace leading upwards from a gas inlet;

c) generating an upwardly directed high-speed jet of fresh gas in the flow pathway;

d) mixing said fresh gas with gas in the hood-shaped annealing furnace; and e) removing the gas mixture at the bottom of the furnace;

said upwardly directed high-speed jet is generated as a pulsating jet having a flow velocity for which the following relation holds $$v = \frac{K \cdot V_f \cdot M_A}{22.4 \cdot \rho_s \cdot A}$$

whereby $V_f$=free furnace chamber volume in litres $M_A$=molar weight of the gas to be rinsed out in g/mol $\rho_s$=density of the fresh gas in g/$m^3$ where these data apply to the standard condition A=entry cross-section of the fresh gas in $m^2$ K=factor with the value $\geqq 1$.

2. In a hood-shaped annealing furnace system comprising:

a pedestal means;

an annealing charge plate means to carry the annealing charge annealed in the hood-shaped annealing furnace;

a blowing means arranged below said annealing charge plate means leading to a central aperture in said annealing charge plate means;

a hood especially surrounding the annealing charge and said annealing charge plate means, an improvement for exchanging the atmosphere in the hood-shaped annealing furnace, said exchange improvement including, a) at least one gas inlet arranged in said pedestal means;

b) at least one gas outlet arranged in said pedestal means;

c) an upwardly leading flow pathway into which said at least one gas inlet leads, said at least one gas inlet being formed as an upwardly directed nozzle leading into a ring-shaped space formed between said annealing charge and said hood, said exchange improvement being arranged and formed such that an upwardly directed high-speed jet of fresh gas is generated and directed through said upwardly leading flow pathway at a flow velocity that satisfies the following relation:

whereby $$v = \frac{K \cdot V_f \cdot M_A}{22.4 \cdot \rho_s \cdot A}$$

$V_f$=free furnace chamber volume in litres $M_A$=molar weight of the gas to be rinsed out in g/mol $\rho_s$=density of the fresh gas in g/$m^3$ where these data apply to the standard condition A=entry cross-section of the fresh gas in $m^2$ K=factor with the value $\geqq 1$;

d) said nozzle comprises a nozzle outlet surface area of approximately 10% of the surface area of said gas outlet means.

3. The improvement according to claim 2 wherein said nozzle has a center line and an outlet diameter, said hood being spaced apart from said center line at a distance that is in the range of 2.5 to 8 times the size of said nozzle outlet diameter.

4. The improvement according to claim 3 wherein said nozzle has a nozzle means at a level at which the annealing charge plate is mounted and an afflux length of a constant diameter extending upstream of the nozzle mouth, said afflux length having a length corresponding substantially to five times said nozzle outlet diameter.

5. The improvement according to claim 2, wherein said gas outlet means is arranged in a ring-shaped space between said annealing charge and said hood diametrically opposite said nozzle.

6. The improvement according to claim 5, wherein said gas outlet is shielded by means of a baffle plate allocated to the blower means.

* * * * *